US012458155B2

(12) United States Patent
Nassar et al.

(10) Patent No.: US 12,458,155 B2
(45) Date of Patent: Nov. 4, 2025

(54) BREASTFEEDING PILLOW SUPPORT DEVICE

(71) Applicants: Leila Nassar, Allentown, PA (US); David Morcos, Bridgewater, NJ (US)

(72) Inventors: Leila Nassar, Allentown, PA (US); David Morcos, Bridgewater, NJ (US)

( * ) Notice: Subject to any disclaimer, the term of this patent is extended or adjusted under 35 U.S.C. 154(b) by 239 days.

(21) Appl. No.: 18/202,027

(22) Filed: May 25, 2023

(65) Prior Publication Data

US 2024/0389772 A1 Nov. 28, 2024

(51) Int. Cl.
*A47D 13/08* (2006.01)
*A47G 9/10* (2006.01)

(52) U.S. Cl.
CPC ..... *A47D 13/083* (2013.01); *A47G 9/1009* (2013.01)

(58) Field of Classification Search
CPC .... A47D 13/083; A47G 9/1009; A47C 27/02; A47C 27/025
See application file for complete search history.

(56) References Cited

U.S. PATENT DOCUMENTS 2,719,577 A * 10/1955 Eyman ..... B61D 33/005 5/640
5,974,607 A * 11/1999 Smith ..... A47C 7/383 5/636
9,032,570 B1 * 5/2015 Benami ..... A47G 9/1009 5/640
9,687,084 B2 6/2017 Sclare et al.
2003/0196269 A1 * 10/2003 Britto ..... A47D 13/083 5/636
2017/0135506 A1 * 5/2017 Holmes ..... A47G 9/1009
2020/0060450 A1 * 2/2020 Wong ..... A47C 27/20
2023/0404301 A1 * 12/2023 Reiss ..... A63H 3/02

FOREIGN PATENT DOCUMENTS

CN 106618038 A * 5/2017 ..... A47D 13/083
CN 218164731 U * 12/2022

* cited by examiner

*Primary Examiner* — Eric J Kurilla
(74) *Attorney, Agent, or Firm* — Kattina V. Barsik, Esq.

(57) ABSTRACT

The present disclosure discloses a pliable frame for a pillow. The pliable frame comprises an inner periphery, an outer periphery, a top side, a bottom side, a first pliable arm, a second pliable arm, a pivotal coupling and a tensioning member. The first and second pliable arm has a plurality of first and second rigid members and a plurality of first and second pliable joint coupled to the plurality of first and second rigid members. The pivotal coupling may pivotally couple the first pliable arm and the second pliable arm to provide pivotal movement of the first pliable arm and the second pliable arm along a pivotal axis. The tensioning member is coupled to the first pliable arm and the second pliable arm is proximate to the pivotal coupling to provide tension against the pivotal movement on the first and second pliable arms.

25 Claims, 11 Drawing Sheets

BREASTFEEDING PILLOW SUPPORT DEVICE

FIELD OF THE DISCLOSURE

The present disclosure is related to pillow accessories, and, more specifically, to a pliable frame for a pillow or a pillow with the pliable frame that may for example be used by a user or mother for feeding a baby which will reduce reflux and can be used easily by a mother or user with carpal tunnel in their hand.

BACKGROUND OF THE DISCLOSURE

There is a learning curve when it comes to nursing for the majority of people. There will be a lot of minor things to get used to, such as placing an infant into a comfortable nursing posture by using a nursing pillow. An infant can be supported next to the mother by using a nursing pillow to help with this. The newborn can be positioned at the upper body of the mother for feeding on a sturdy and comfortable surface thanks to nursing cushions that sit in your lap. However, such a nursing pillow may not be able to comfortably wrap around a user's body, may not help reduce reflux of a baby, and may not be easy to use for someone suffering from carpal tunnel.

The unique features and extras of nursing pillows are quite practical during the first few months, according to many new mothers. Even if the mother doesn't intend to breastfeed, a nursing pillow can still be quite helpful for improving the comfort of bottle feeding.

Various forms of conventional pillows known in the prior art are provided with rigid frames. Such pillows with rigid frames are designed according to the size of a newborn baby and not according to the size of the mother or user. Existing pillows and frames for pillows known in the prior art fail to accommodate in accordance with the size of the upper body of the user or mother. Existing pillows do not help reduce reflux of a baby and are not made for ease of use for someone suffering from carpel tunnel.

As such, there exists a need for a pliable frame for a nursing pillow and a pliable nursing pillow thereof to fit the pillow around a user's waist when the pillow is used by the user for holding or feeding a baby. There may also exist a need for a pliable frame for a nursing pillow and a pliable nursing pillow thereof to comfortably accommodate a baby and can adjust the baby along the pliable nursing pillow, and may provide one or more feeding positions to the baby while the mother is using the pillow. There may additionally exist a need for a pliable nursing pillow for babies with reflux and for mothers or users suffering from carpal tunnel syndrome.

SUMMARY OF THE DISCLOSURE

In view of the foregoing disadvantages inherent in the prior art, the general purpose of the present disclosure is to provide a pliable frame for a pillow and a pillow thereof, to include all advantages of the prior art, and to overcome the drawbacks inherent in the prior art.

An object of the present disclosure is to provide a pliable frame for a nursing pillow and a pliable nursing pillow thereof to fit the pillow around a user's waist when the pillow is used by the user for holding or feeding a baby. Another object of the present disclosure is to provide a pliable frame for a nursing pillow and a pliable nursing pillow thereof to comfortably accommodate a baby, can adjust the baby along the pliable nursing pillow, and may provide one or more feeding positions to the baby while the mother is using the pillow. Yet another object of the present invention is to provide a pliable frame for a nursing pillow that can reduce reflux of a baby. A further object of the present invention is to provide a pliable nursing pillow that is easy to use for mothers or users that suffer from carpal tunnel syndrome in their hand.

In view of the above objects, in one aspect, the current disclosure provides a pillow having a pliable frame to fit the pillow around a user's waist when the pillow is used by the user for holding or feeding a baby.

Embodiments in accordance with the present disclosure disclose a pliable frame for a pillow. The pliable frame comprises an inner periphery, an outer periphery, a top side, a bottom side, a first pliable arm, a second pliable arm, a pivotal coupling and a tensioning member. The first pliable arm may have a plurality of first rigid members, and a plurality of first pliable joint coupled to the plurality of first rigid members. The second pliable arm may be pivotally coupled to the first pliable arm. The second pliable arm may have a plurality of second rigid members, and a plurality of second pliable joint coupled to the second rigid members. The first pliable arm and the second pliable arm are bendable towards the inner periphery IP of the pliable frame. In another, embodiment, the first and second pliable arms are bendable towards the top side and the bottom side.

The pivotal coupling may pivotally couple the first pliable arm and the second pliable arm to provide pivotal movement of the first pliable arm and the second pliable arm along a pivotal axis. The pivotal coupling is configured to allow movement of the first pliable arm and the second pliable arm in a horizontal plane.

The tensioning member is coupled to the first pliable arm and the second pliable arm is proximate to the pivotal coupling to provide tension against the pivotal movement on the first and second pliable arms. The tensioning member is selected from a spring or an elastic rubber strip. In an embodiment, tensioning member is provided on the inner periphery IP of the pliable frame. The tensioning member assists the pliable frame arms to grapple the body of the user. This helps the users to the nursing pillow in a standing position also.

In an embodiment, in the pliable frame, each of the first pliable joints and the second pliable joints of the first and second arms comprises a ratchet mechanism between two adjacent rigid members of the plurality of the first and second rigid members.

The ratchet mechanism having a ratchet, a hinge joint and a pin lock. The ratchet may be provided at one rigid member of the two adjacent rigid members. The hinge joint couples two adjacent rigid members such that the ratchet overlaps another rigid member of the two adjacent rigid members and forms an overlap region. The pin lock is movably engaged with the ratchet along another rigid member at the overlap region.

In an embodiment of the present disclosure, each of the first and second pliable joints of the first and second arms is free to pliably move the first and second rigid members towards the top side and locked to pliably move towards the bottom side. In another embodiment of the present disclosure, the downward pliable movement of one of the two adjacent rigid members is locked by the pin lock and the pin lock is required to be pulled to allow the downward pliable movement of one of the adjacent rigid members.

Further, each of the first and second pliable joints of the first and second arms comprises a pliable strip or a pliable rod between two adjacent rigid members of the plurality of the first and second rigid members. The first and second pliable arms are bendable towards the top side TS and the bottom side BS. The pliable strip is of material comprised of aluminium, copper, bronze, brass, steel, lead, Polyethylene (PE), Polypropylene (PP), Polyvinyl chloride (PVC), Polystyrene (PS), Polyurethane (PU), Acrylonitrile butadiene styrene (ABS), Thermoplastic elastomers (TPE), Polycarbonate (PC), Thermoplastic polyester (PET), Polyvinylidene fluoride (PVDF) or a combination thereof. The first pliable arm and the second pliable arm may be bendable towards the inner periphery of the pliable frame.

In yet another embodiment, the pliable frame of the pillow is having at least one tensioning wire. The tensioning wire is having a first end and a second end, the tensioning wire passes through at least one of the first pliable arms or the second pliable arm. The tensioning wire is configured to increase or decrease spacing in the first or the second pliable joint. The first end of the tensioning wire is fixed on at least one of the first rigid members or the second rigid members. At least one tensioning knob is also provided on at least one of the first rigid members or the second rigid members. The tensioning knob is attached to the second end of the tensioning wire and the tensioning knob is configured to tighten or loosen the tensioning wire.

In an embodiment, each of the first and second pliable joints is a tooth lock mechanism between two adjacent rigid members of the plurality of the first and second rigid members. The tooth lock mechanism is having a first engaging member and a second engaging member configured to couple with each other. The first engaging member having a plurality of tooths is provided at one rigid member of the two adjacent rigid members. The second engaging member is having a plurality of tooths provided at the other rigid member of the two adjacent rigid members. The second engaging member is configured to couple with the first engaging member on tightening the tensioning wire. The first engaging member is of concave shape, and the second engaging member is of convex shape. The second engaging member is configured to fit in the first engaging member.

In another aspect, as illustrated in the present disclosure provides a pliable frame for a pillow and the pliable frame is defined by an inner periphery, an outer periphery, a top side and a bottom side. The pliable frame includes a first pliable arm, a second pliable arm, a pivotal coupling, a tensioning member, at least one tensioning wire, and at least one tensioning knob. The first pliable arm has a plurality of first rigid members, and a plurality of first pliable joint coupled to the plurality of first rigid members. The second pliable arm has a plurality of second rigid members, and a plurality of second pliable joint is coupled to the second rigid members. The pivotal coupling pivotally couples the first pliable arm and the second pliable arm to provide pivotal movement of the first and second pliable arms along a pivotal axis. The tensioning member coupled to the first pliable arm and the second pliable arm proximate to the pivotal coupling to provide tension against the pivotal movement on the first and second pliable arm. The tensioning wire has a first end and a second end. The tensioning wire passes through at least one of the first pliable arm or the second pliable arm and is configured to increase or decrease spacing in the first or the second pliable joint, the first end of the tensioning wire is fixed on at least one of the first rigid members or the second rigid members. The tensioning knob is provided on at least one of the first rigid members or the second rigid members. The tensioning knob is attached to the second end of the tensioning wire and the tensioning knob is configured to tighten or loosen the tensioning wire.

The first pliable joint and the second pliable joint is a tooth lock mechanism. The tooth lock mechanism is provided between two adjacent rigid members of the plurality of the first and second rigid members to form the first and second pliable joint. The tooth lock mechanism has a first engaging member and a second engaging member. The first engaging member has a plurality of tooths provided at one rigid member of the two adjacent rigid members. The second engaging member has a plurality of tooths is provided at other rigid member of the two adjacent rigid members. The second engaging member is configured to couple with the first engaging member on tightening of the tensioning wire.

In another aspect, the present disclosure discloses a pillow comprising a body with a medial region and a pair of pliable arms extending from the medial region, a closable opening provided on the medial region, a filing material filed in the body, and a pliable frame removably placed inside the pillow body through the closable opening.

The pliable frame provided in the pillow comprises an inner periphery, an outer periphery, a top side, a bottom side, a first pliable arm, a second pliable arm, a pivotal coupling and a tensioning member. The first pliable arm has a plurality of first rigid members, and a plurality of first pliable joint coupled to the plurality of first rigid members. The second pliable arm is pivotally coupled to the first pliable arm, the second pliable arm having a plurality of second rigid members, and a plurality of second pliable joint coupled to the second rigid members. The pivotal coupling pivotally couples the first pliable arm and the second pliable arm to provide pivotal movement of the first and second pliable arms along a pivotal axis. The tensioning member coupled to the first pliable arm and the second pliable arm proximate to the pivotal coupling to provide tension against the pivotal movement on the first and second pliable arm.

In an embodiment, the pliable frame of the pillow further comprises a ratchet mechanism between two adjacent rigid members of the plurality of the first and second rigid members. The ratchet mechanism is having a ratchet, a hinge joint, and a pin lock. The ratchet is provided at one rigid member of the two adjacent rigid members. The hinge joint couples two adjacent rigid members such that the ratchet overlaps another rigid member of the two adjacent rigid members and forms an overlap region. The pin lock movably engaged with the ratchet along another rigid member at the overlap region.

In an embodiment, the pliable frame of the pillow comprises a plurality of rigid members joined with a plurality of pliable strips. The pair of pliable arms are free to pliably bend towards the top side of the pillow and locked to pliably bend towards the bottom side of the pillow.

In yet another embodiment, the pliable frame of the pillow is having at least one tensioning wire. The tensioning wire is having a first end and a second end, the tensioning wire passes through at least one of the first pliable arms or the second pliable arm. The tensioning wire is configured to increase or decrease spacing in the first or the second pliable joint. The first end of the tensioning wire is fixed on at least one of the first rigid members or the second rigid members. At least one tensioning knob is also provided on at least one of the first rigid members or the second rigid members. The tensioning knob is attached to the second end of the tensioning wire and the tensioning knob is configured to tighten or loosen the tensioning wire.

In an embodiment, each of the first and second pliable joints is a tooth lock mechanism between two adjacent rigid members of the plurality of the first and second rigid members. The tooth lock mechanism is having a first engaging member and a second engaging member configured to couple with each other. The first engaging member having a plurality of tooths is provided at one rigid member of the two adjacent rigid members. The second engaging member is having a plurality of tooths provided at the other rigid member of the two adjacent rigid members. The second engaging member is configured to couple with the first engaging member on tightening the tensioning wire. The first engaging member is of concave shape, and the second engaging member is of convex shape. the second engaging member is configured to fit in the first engaging member.

The pillow may be a nursing pillow and the pliable arms of the pillow are bendable to accommodate a baby placed on the top side of the pillow. The pliable frame is configured to fit the pillow around a user's waist when the pillow is used by the user for holding or feeding a baby. The pillow body is having a medial region and a pair of pliable arms extending from the medial region, a closable opening, and a filing material. The closable opening extends from the medial region to the pair of pliable arms. The filing material is filed in the pillow body. Further, the pliable frame defined by an inner periphery, an outer periphery, a top side and a bottom side, removably placed inside the pillow body through the closable opening and be covered by the filing material.

BRIEF DESCRIPTION OF THE DRAWINGS

The advantages and features of the present disclosure will become better understood with reference to the following detailed description taken in conjunction with the accompanying drawing, in which.

Like reference numerals refer to like parts throughout the description of several views of the drawing.

DETAILED DESCRIPTION OF THE DISCLOSURE

The exemplary embodiments described herein detail for illustrative purposes are subject to many variations in implementation. The present disclosure provides a pliable frame and a pillow using said pliable frame. It should be emphasized, however, that the present disclosure is not limited only to what is disclosed and extends to cover various alternations to the ergonomic use. It is understood that various omissions and substitutions of equivalents are contemplated as circumstances may suggest or render expedient, but these are intended to cover the application or implementation without departing from the scope of the present disclosure.

The terms "a" and "an" herein do not denote a limitation of quantity, but rather denote the presence of at least one of the referenced items.

The terms "having," "comprising," "including," and variations thereof signifies the presence of a component.

Figure 1:
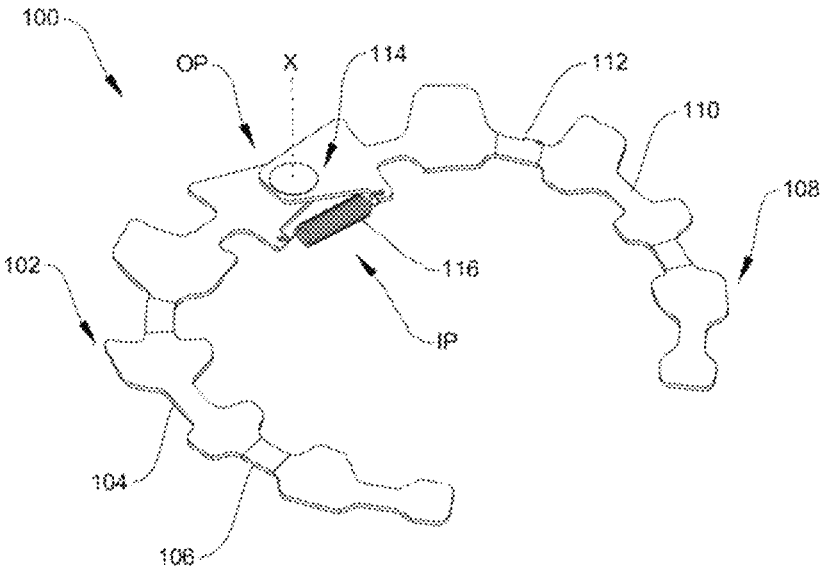
FIG. 1 illustrates a perspective view of a pliable frame for a pillow, according to one embodiment of the present disclosure disclosed herein.
Figure 2:
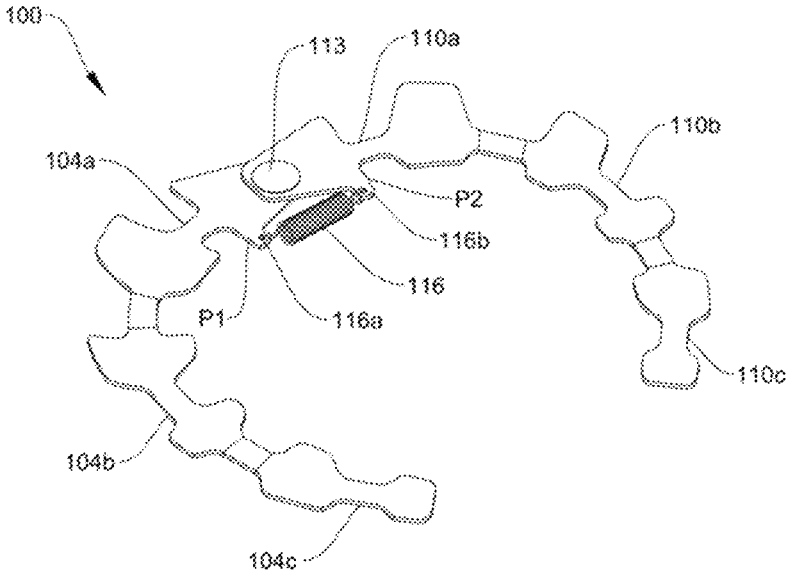
FIG. 2 illustrates a perspective view of a pliable frame for a pillow, according to one embodiment of the present disclosure disclosed herein.
Figure 3:
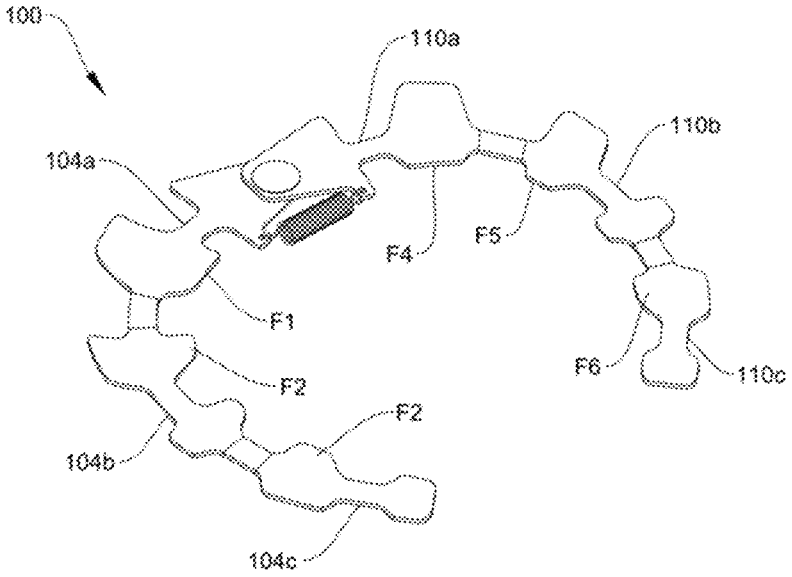
FIG. 3 illustrates a perspective view of a pliable frame for a pillow, according to one embodiment of the present disclosure disclosed herein.
Figure 4A:
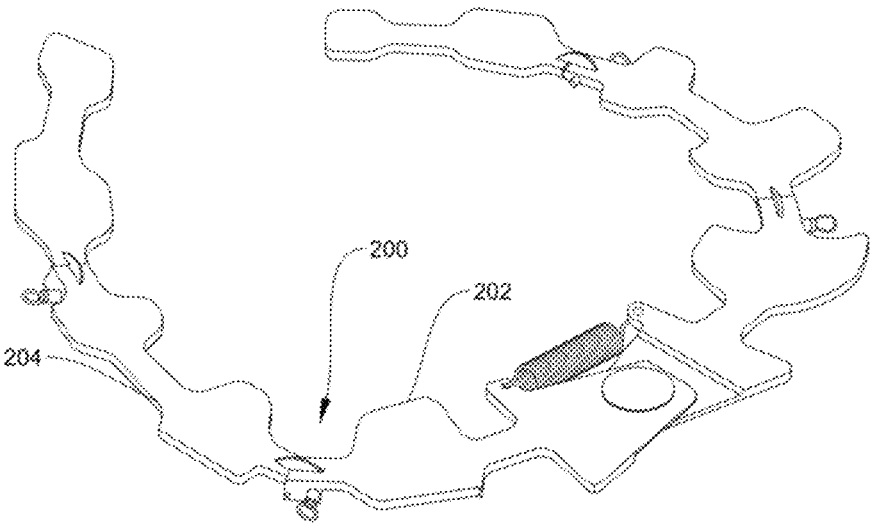
FIG. 4*a* illustrates another perspective view of a pliable frame for a pillow, according to one embodiment of the present disclosure disclosed herein.
Figure 4B:
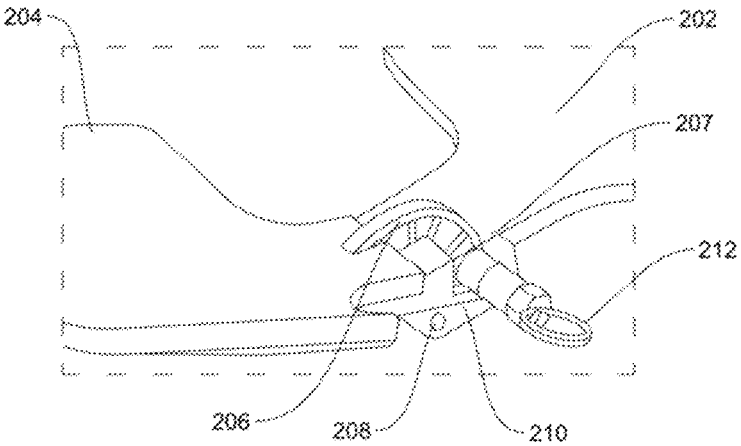
FIG. 4*b* illustrates a magnified view of a pliable joint of the pliable frame, according to one embodiment of the present disclosure disclosed herein.
Figure 5:
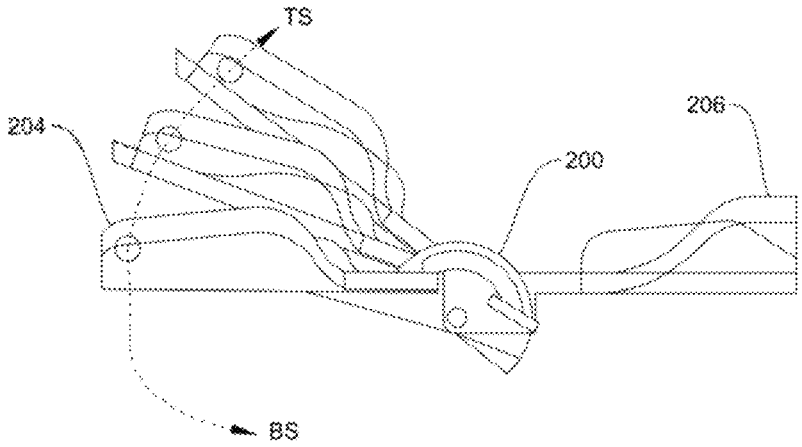
FIG. 5 illustrates a magnified view of a ratchet mechanism of a pliable frame for a pillow, according to one embodiment of the present disclosure disclosed herein.

In an aspect of the present disclosure, the present disclosure discloses a pliable frame for a pillow as illustrated in FIG. 1, FIG. 2 and FIG. 3. The pliable frame 100 comprises an inner periphery IP, an outer periphery OP, a top side TS, a bottom side BS, a first pliable arm 102, a second pliable arm 108, a pivotal coupling 114 and a tensioning member 116.

The first pliable arm 102 may have a plurality of first rigid members 104, and a plurality of first pliable joint 106 coupled to the plurality of first rigid members 104.

The second pliable arm 108 may be pivotally coupled to the first pliable arm 102. The second pliable arm 108 may have a plurality of second rigid members 110, and a plurality of second pliable joint 112 coupled to the second rigid members 110.

In an embodiment, the first pliable arm 102 and the second pliable arm 108 may be bendable towards the inner periphery IP of the pliable frame 100.

In another, embodiment, the first and second pliable arms 102, 108 may be bendable towards the top side TS and the bottom side BS.

The pivotal coupling 114 may pivotally couple the first pliable arm 102 and the second pliable arm 108 to provide pivotal movement of the first pliable arm 102 and the second pliable arm 108 along a pivotal axis X. The pivotal coupling 114 may allow movement of the first pliable arm 102 and the second pliable arm 108 in a horizontal plane.

The tensioning member 116 may be coupled to the first pliable arm 102 and the second pliable arm 108 in proximity to the pivotal coupling 114 to provide tension against the pivotal movement on the first and second pliable arms. The tensioning member 116 may include but is not limited to, a spring or an elastic rubber strip. In some embodiment, tensioning member 116 may be provided on the inner periphery IP of the pliable frame 100.

Figure 7:
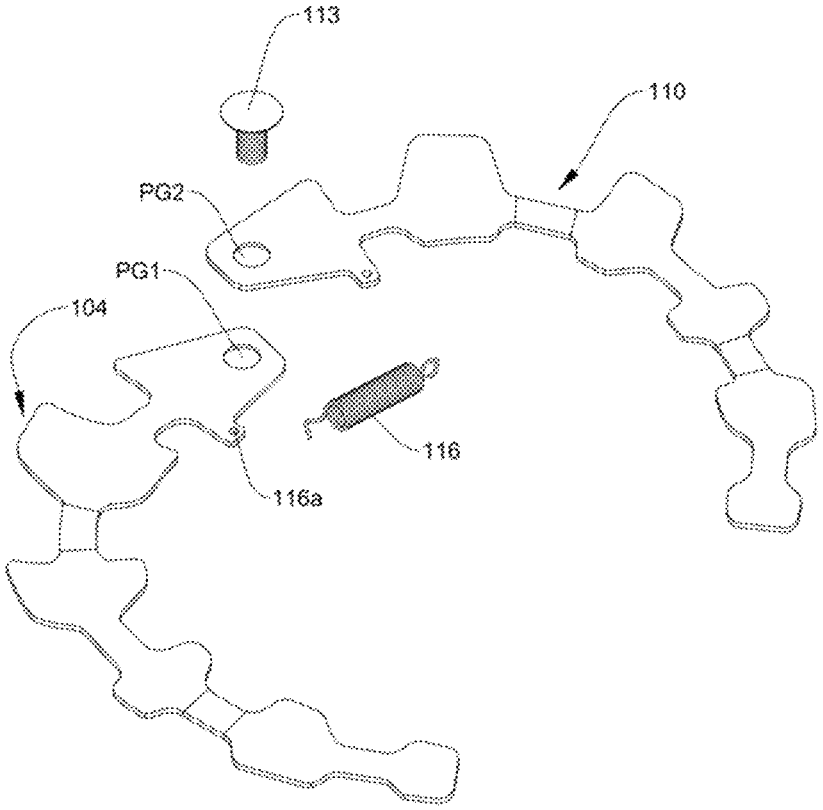
FIG. 7 illustrates an exploded view of a pliable frame for a pillow, according to one embodiment of the present disclosure.
Figure 8:
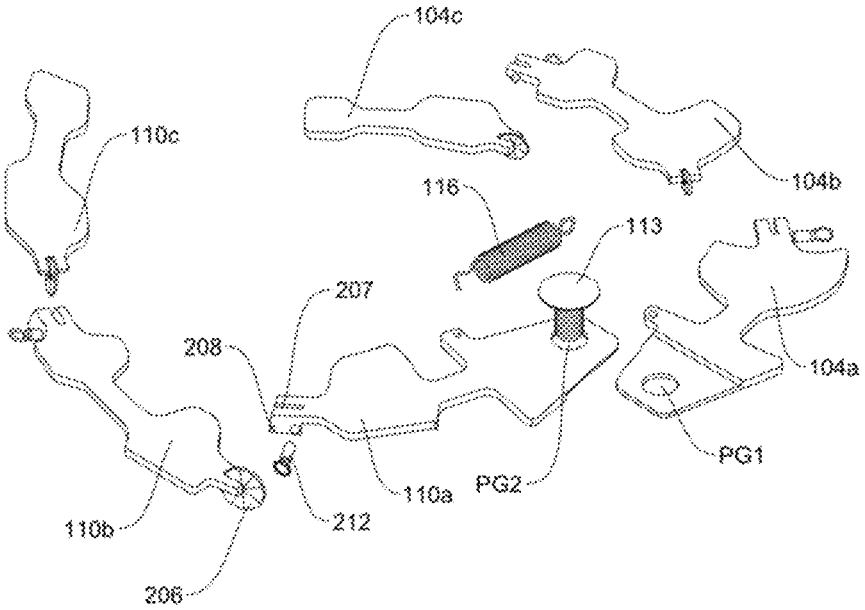
FIG. 8 illustrates an exploded view of another pliable frame for a pillow, according to another embodiment of the present disclosure.

The first pliable arm 102 has the plurality of first rigid members 104*a*, 104*b*, 104*c* adjacently joined with the plurality of first pliable joints 106*a*, 106*b*. For example, as shown in FIG. 2, the first rigid member 104*a* is coupled to the adjacently disposed first pliable joint 106*a*. Similarly, the second pliable arm 108 has the plurality of second rigid members 110*a*, 110*b*, 110*c* adjacently joined with the plurality of second pliable joints 112*a*, 112*b*. For example, as shown in FIG. 2, FIG. 7 and FIG. 8, the second rigid member 110*a* is coupled to the adjacently disposed second pliable joint 112*a*. One free end of only one first rigid member 104*a* and one free end of only one second rigid member 110*a* are having a first and a second pivot grooves PG1, PG2 respectively. The first pivot groove PG1 of the first rigid member 104*a* of the first pliable arm 104 is overlayed on the second pivot groove PG2 of the second rigid member 110*a* to concentrically arrange the pivot grooves. A pivot pin 113 is fitted through the concentric pivot grooves to provide the pivotal coupling 114. The first pliable arm 102 and the second pliable arm 108 are coupled to form a C-shaped frame defining the inner periphery IP, the outer periphery OP, the top side TS and the bottom side.

In one embodiment, the tensioning member 114 may be provided on the inner periphery IP. As shown in FIG. 2 in an example arrangement, the first rigid member 104*a* and the second rigid member 110*a* are having a protrusion P1, P2 provided on the inner periphery IP along the respective free ends of the first rigid member 104*a* and the second rigid member 110*a*, as defined earlier. Each of the protrusions P1, P2 is having a first and a second tensioning groove 116*a*, 116*b* respectively. Ends of the tension member 116 are fitted in the tensioning grooves 116*a*, 116*b*. However, without departing from the scope of the present disclosure, the tensioning member 114 may be provided on the outer periphery OP.

In an embodiment, at least one first rigid member 104 of the first pliable arm 102 and the at least one second rigid member 110 of the second pliable arm 108 may be provided with fins F for providing a surface for support. As illustrated in FIG. 3, the first pliable arm 102 is having three different first rigid members 104*a*, 104*b*, 104*c*. Each of the three first rigid members 104*a*, 104*b*, 104*c* is having quadruple fins F1, F2, F3. Similarly, the second pliable arm 108 is having three different second rigid members 110*a*, 110*b*, 110*c*. Each of the three first rigid members 110*a*, 110*b*, 110*c* is having quadruple fins F4, F5, F6. The fins have varying widths to provide support across the pillow. The width of the fins F1 and F4 provided on the pivotally coupled first rigid member 104*a* and the second rigid member 110*a* is wider as compared to other fins F2, F3, F5, F6. The width of the fins F3, F6 provided on the first rigid member 104*c* and the second rigid member 110*c* having free ends is narrowest as compared to other fins F2, F1, F5, F4. The structure of the first pliable arm 102 is a mirror image of the structure of the second pliable arm 108.

In an embodiment, in the pliable frame 100 as illustrated in FIG. 4*a*, FIG. 4*b*, FIG. 5 and FIG. 8, each of the first pliable joints 106 and the second pliable joints 112 of the first and second arms 102, 108 may comprise a ratchet mechanism 200 between two adjacent rigid members 202, 204 of the plurality of the first and second rigid members.

The ratchet mechanism 200 may have a ratchet 206, a hinge joint 208 and a pin lock 212. The ratchet 206 may be provided at one rigid member 202 of the two adjacent rigid members 202, 204. A U-shaped 207 casing may be provided on the other rigid member 204 of the two adjacent rigid members 202, 204. The hinge joint 208 may be coupled to two adjacent rigid members 202, 204 such that the ratchet fit in the U-shaped casing and overlaps another rigid member 204 of the two adjacent rigid members to form an overlap region 210. The pin lock 212 is movably engaged with the ratchet 206 along another rigid member at the overlap region 210.

In an embodiment of the present disclosure, the one rigid member 202 of the adjacent rigid members 202, 204 having the ratchet is free to pliably move towards the top side TS and locked to pliably move towards the bottom side BS and locked by the pin lock 212 to pliably move towards the bottom side. The pin lock is required to be pulled to allow pliable movement of the one rigid member 202 of the adjacent rigid members towards 202, 204 the bottom side BS. However, without departing from the scope of the present disclosure there may be other types of ratchet or ratchet mechanisms for said purpose. For example, in another embodiment of the present disclosure, the pliable movement of one of the two adjacent rigid members 202, 204 towards the bottom side BS is locked by the pin lock 212, and the pin lock 212 may be required to be pushed to allow the pliable movement towards the bottom side BS of one of the adjacent the rigid members 202, 204.

Referring back to FIGS. 1, 2 and 3, in another embodiment, each of the first and second pliable joints 106, 112 of the first and second arms 102, 108 may be a pliable strip or a pliable rod coupled to two adjacent rigid members of the plurality of the first and second rigid members. One of the two adjacent rigid members of the plurality of the first and second rigid members is movable towards the top side TS and the bottom side BS along the respective pliable strip. The pliable strip may be made of material comprised of aluminium, copper, bronze, brass, steel, lead, Polyethylene (PE), Polypropylene (PP), Polyvinyl chloride (PVC), Polystyrene (PS), Polyurethane (PU), Acrylonitrile butadiene styrene (ABS), Thermoplastic elastomers (TPE), Polycarbonate (PC), Thermoplastic polyester (PET), Polyvinylidene fluoride (PVDF), or a combination thereof. In an embodiment, the first pliable arm 102 and the second pliable arm 108 may be bendable towards the inner periphery IP of the pliable frame 100 via the pliable rods.

Figure 6:
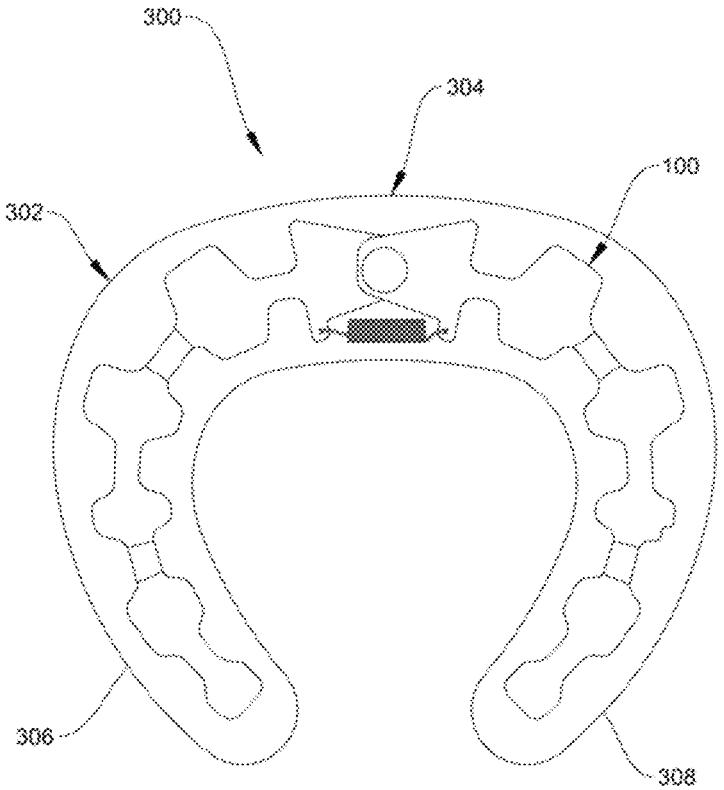
FIG. 6 illustrates a perspective view of a pillow, according to one embodiment of the present disclosure disclosed herein.

In another aspect as illustrated in FIG. 6, the present disclosure discloses a pillow 300 having a body 302 with a medial region 304. The pillow 300 further includes a pair of pliable arms 306, 308 extending from the medial region 304. A closable opening 310 may be provided on the medial region 304 of the pillow 300. Further, a filing material may be provided to be filled in the body 302. Furthermore, the pillow 300 may include a pliable frame, such as the pliable frame 100, removably placed inside the pillow body 302 through the closable opening 310. The pliable frame 100 in the pillow 300 is the same as explained previously. Therefore, for sake of brevity, the description of the pliable frame 100 is not repeated again.

In an embodiment, the pillow 300 may be a C-shaped or U-shaped nursing pillow. The pillow 300 may be designed to be used while feeding a baby. The pillow 300 may be a nursing pillow and the pliable arms of the pillow 300 are bendable to accommodate a baby placed on the top side of the pillow 300. The pliable frame 100 may be configured to fit the pillow 300 around a user's waist when the pillow 300 is used by the user for holding a baby.

In another embodiment, the pair of pliable arms 306, 308 is free to pliably bend towards the top side of the pillow 300 and locked to pliably bend towards the bottom side of the pillow 300 with the help of the pliable frame 100.

Figure 9:
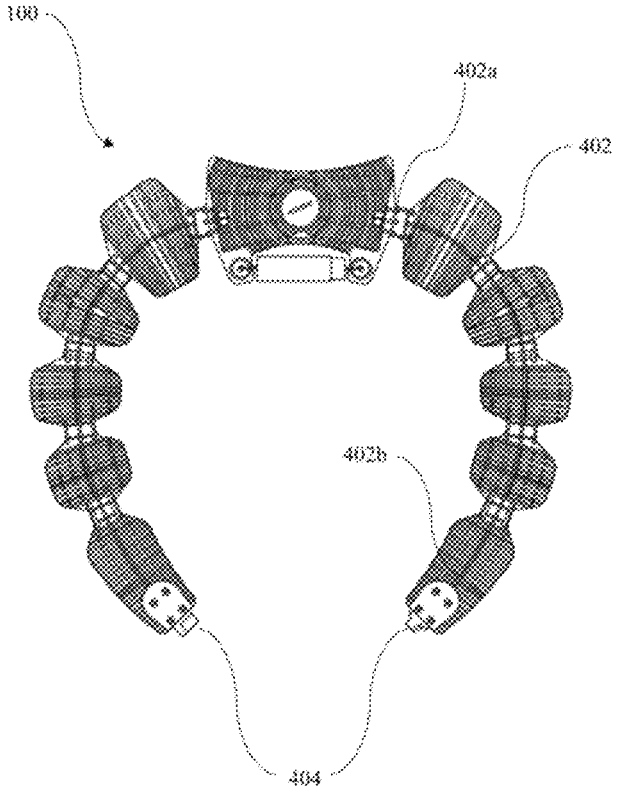
FIG. 9 illustrates a top view of a pliable frame for a pillow, according to another embodiment of the present disclosure.
Figure 10:
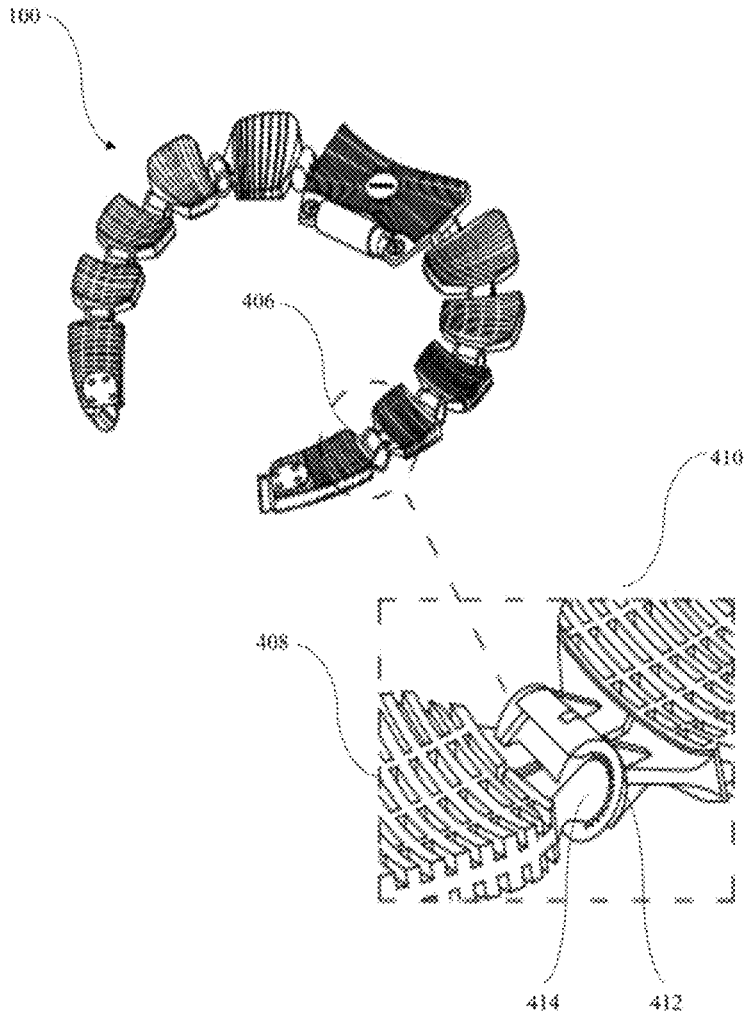
FIG. 10 illustrates a perspective view of a pliable frame and a magnified view of a pliable joint of the pliable frame, according to one embodiment of the present disclosure disclosed herein.
Figure 11A:
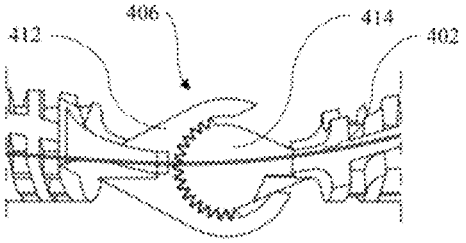
FIG. 11*a* illustrates a side view of a pliable joint with tightened tensioning wire, according to one embodiment of the present disclosure disclosed herein.
Figure 11B:
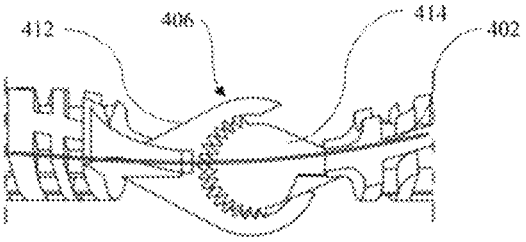
FIG. 11*b* illustrates a side view of a pliable joint with loosened tensioning wire, according to one embodiment of the present disclosure disclosed herein.
Figure 11C:
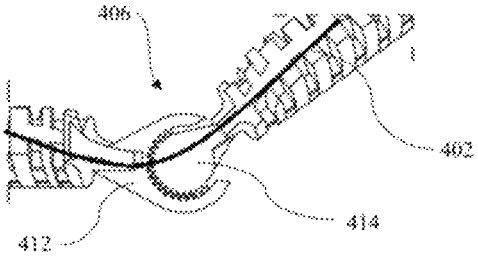
FIG. 11*c* illustrates a side view of a bent pliable joint with tightened tensioning wire, according to one embodiment of the present disclosure disclosed herein.

In yet another embodiment as illustrated in FIG. 9, the pliable frame (100) of the pillow is having at least one tensioning wire 402. The tensioning wire 402 is having a first end 402*a* and a second end 402*b*, the tensioning wire 402 passes through at least one of the first pliable arms 102 or the second pliable arm 108. The tensioning wire 402 is configured to increase or decrease spacing in the first 106 or the second pliable joint 112. The first end 402*a* of the tensioning wire 402 is fixed on at least one of the first rigid members 104 or the second rigid members 110. At least one tensioning knob 404 is also provided on at least one of the first rigid members 104 or the second rigid members 110. The tensioning knob 404 is attached to the second end 402*b* of the tensioning wire 402 and the tensioning knob 404 is configured to tighten or loosen the tensioning wire 402.

In an embodiment as illustrated in FIGS. 10, 11*a*, 11*b*, and 11*c*, each of the first 106 and second pliable joints 112 is a tooth lock mechanism 406 between two adjacent rigid members 408, 410 of the plurality of the first and second rigid members 104, 110. The tooth lock mechanism 406 is having a first engaging member 412 and a second engaging member 414 configured to couple with each other. The first engaging member 412 having a plurality of tooths is provided at one rigid member 408 of the two adjacent rigid members 408, 410. The second engaging member 414 is having a plurality of tooths provided at the other rigid member 410 of the two adjacent rigid members 408, 410. The second engaging member 414 is configured to couple with the first engaging member 412 on tightening the tensioning wire 402. The first engaging member 412 is of concave shape, and the second engaging member 414 is of convex shape. The second engaging member 414 is configured to fit in the first engaging member 412.

In another aspect, as illustrated in FIG. 9 the present disclosure provides a pliable frame 100 for a pillow and the pliable frame is defined by an inner periphery, an outer periphery, a top side and a bottom side. The pliable frame 100 includes a first pliable arm 102, a second pliable arm 108, a pivotal coupling 114, a tensioning member 116, at least one tensioning wire 402, and at least one tensioning knob 404. The first pliable arm 102 has a plurality of first rigid members 104, and a plurality of first pliable joint 106 coupled to the plurality of first rigid members. The second pliable arm 108 has a plurality of second rigid members 110, and a plurality of second pliable joint 112 coupled to the second rigid members 110. The pivotal coupling 114 pivotally couples the first pliable arm 102 and the second pliable arm 108 to provide pivotal movement of the first and second pliable arms 102, 108 along a pivotal axis X. The tensioning member 116 coupled to the first pliable arm 102 and the second pliable arm 108 proximate to the pivotal coupling 114 to provide tension against the pivotal movement on the first and second pliable arm 102, 108. The tensioning wire 402 has a first end 402*a* and a second end 402*b*. The tensioning wire 402 passes through at least one of the first pliable arm 102 or the second pliable arm 108 and is configured to increase or decrease spacing in the first 106 or the second pliable joint 112, the first end 102*a* of the tensioning wire 402 is fixed on at least one of the first rigid members 104 or the second rigid members 110. The tensioning knob 404 is provided on at least one of the first rigid members 104 or the second rigid members 110. The tensioning knob 404 is attached to the second end 402*b* of the tensioning wire 402 and the tensioning knob 404 is configured to tighten or loosen the tensioning wire 402.

The first pliable joint 106 and the second pliable joint 112 is a tooth lock mechanism 406. The tooth lock mechanism 406 is provided between two adjacent rigid members 408, 410 of the plurality of the first and second rigid members to form the first 106 and second pliable joint 112. the tooth lock mechanism 406 has a first engaging member 412 and a second engaging member 414. The first engaging member 412 has a plurality of tooths provided at one rigid member 408 of the two adjacent rigid members 408,410. The second engaging member 414 has a plurality of tooths is provided at other rigid member 410 of the two adjacent rigid members 408, 410. The second engaging member 414 is configured to couple with the first engaging member 412 on tightening of the tensioning wire 402.

The present disclosure described hereinabove has several technical advantages including, but not limited to a pliable frame and a pliable pillow with the pliable frame.

The pliable pillow of the present disclosure is configured to be used by a user in standing as well as sitting positions. Whereas the nursing pillow known in the prior art fails to disclose any grappling feature or pliable feature in the nursing pillow that can assist the user to use the pillow in standing as well as sitting positions. The pliable frame helps to maintain the shape of the pillow, providing support for the head, neck and body of a baby. The pliable frame helps to distribute pressure evenly across the pillow, providing a more comfortable surface for feeding a baby and reduces reflux of a baby. The pliable frame helps to prevent the pillow from becoming misshapen over time, increasing its overall lifespan. The pliable frame can be adjusted to the user's preferred level of firmness, allowing for a personalized experience, as well as easy to use especially for mothers or users suffering from conditions such as carpal tunnel syndrome. The pliable frame and pliable nursing pillow are designed to fit the pillow around a user's waist when the pillow is used by the user for holding or feeding a baby. The pivotal coupling pivotally couples the first pliable arm and the second pliable arm to provide pivotal movement of the first and second pliable arms along a pivotal axis. The pivotal coupling is designed to increase or decrease the inner periphery to wrap around the body of the user during feeding or holding the baby. The pliable pillow of the present disclosure lessens the user's neck, arm, and back strain, which can make nursing the baby simpler and more pleasurable for the user and baby. The pliable pillow of the present disclosure is comfortable to single-handedly hold the baby because of the pliable frame of the nursing pillow. No strap is required in the nursing pillow to wrap the arms of the pillow around a user. The tensioning member of the pliable frame enables the pillow arms to grapple the body of the user and assist single-hand use by the user.

The pliable nursing pillow of the present disclosure may work in two configurations. In the first configuration, the pillow is placed on lap of the user for feeding a baby. The pliable arms of the pillow are bent towards the top side so that the baby is comfortably placed between the medial region and the pliable arms. In the second configuration, the pillow arms are placed around the body of the user and the baby is placed on the medial region for feeding. In this configuration, the pillow grapples around the body of the user. Unique feature on the pliable frame.

The pliable frame has various important functions to perform. The pliable frame's inner periphery can be stretched or contracted according to the size of the user. The pliable frame arms grapple the body of the user to assist single-hand use by the user. The pliable arms get additional support from the back of the user when pliably bent in an upward direction.

The pliable frame in the nursing pillow could also be used for babies with gastroesophageal reflux. Babies could be fed in more of an upright position to help with the reflux.

Mothers who have carpal tunnel of the wrist could find it more of a challenge to hold the baby while nursing, the pliable frame when pushed up to one side could support the baby's head so mom does not have to put as much tension on her wrist.

Babies who have torticollis may not feel comfortable with pressure put on their necks, the pliable pillow could be adjusted to keep the baby's head better when breastfeeding and no need for the mother to support the baby's neck.

The first few weeks after delivery the mother could have weakness in her muscles and use the pliable pillow's support to hold the baby more elevated to latch and help with bottle feeding.

While considerable emphasis has been placed herein on the specific features of the preferred embodiment, it will be appreciated that many additional features can be added and that many changes can be made in the preferred embodiment without departing from the principles of the disclosure. These and other changes in the preferred embodiment of the disclosure will be apparent to those skilled in the art from the disclosure herein, whereby it is to be distinctly understood that the foregoing descriptive matter is to be interpreted merely as illustrative of the disclosure and not as a limitation.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the scope of the present disclosure.

| LIST OF REFERENCE NUMERALS | |
|---|---|
| 100 | Pliable frame |
| IP | Inner periphery |
| OP | Outer periphery |
| TS | Tip side |
| BS | Bottom side |
| 102 | First pliable arm |
| 104, 104a, 104b | First rigid member |
| 106, 106a, 106b, 106c | First pliable joint |
| 108 | Second pliable arm |
| 110, 110a, 110b, 110c | Second rigid member |
| 112, 112a, 112b | Second pliable joint |
| X | Pivotal axis |
| 113 | Pivot Pin |
| PG1 | First pivot groove |
| PG2 | Second pivot groove |
| 114 | Pivotal coupling |
| 116 | Tensioning member |
| P1 | Protrusion on a first rigid member |
| P2 | Protrusion on a second rigid member |

-continued

| LIST OF REFERENCE NUMERALS | |
|---|---|
| 116a | First tensioning groove |
| 116b | Second tensioning groove |
| 200 | Ratchet mechanism |
| 202 | One rigid member of two adjacent rigid members of ratchet mechanism |
| 204 | Other rigid member of two adjacent rigid members of ratchet mechanism |
| 206 | Ratchet |
| 207 | U-shaped casing |
| 208 | Hinge joint |
| 210 | Overlap region |
| 212 | Pin lock |
| 300 | Pillow |
| 302 | Body |
| 304 | Medial region |
| 306, 308 | A pair of pliable arms |
| F, F1, F2, F3, F4, F5, F6 | Fins |
| 402 | Tensioning wire |
| 402a | First end of tensioning wire |
| 402b | Second end of tensioning wire |
| 404 | Tensioning Knob |
| 406 | Tooth lock mechanism |
| 408 | One of the two adjacent rigid members of the tooth lock mechanism |
| 410 | Other rigid member of two adjacent rigid members of the tooth lock mechanism |
| 412 | First engaging member |
| 414 | Second engaging member |

What is claimed is:

1. A pliable frame for a pillow and the pliable frame is defined by an inner periphery, an outer periphery, a top side and a bottom side, and the pliable frame comprising:

a first pliable arm having a plurality of first rigid members, and a plurality of first pliable joints coupled to the plurality of first rigid members;

a second pliable arm having a plurality of second rigid members, and a plurality of second pliable joints coupled to the plurality of second rigid members, a pivotal coupling pivotally couples the first pliable arm and the second pliable arm to provide a pivotal movement of the first and second pliable arms along a pivotal axis; and a tensioning member coupled to the first pliable arm and the second pliable arm proximate to the pivotal coupling to provide tension against the pivotal movement on the first and second pliable arms.

2. The pliable frame as claimed in claim 1, wherein each of the first and second pliable joints is a ratchet mechanism between two adjacent rigid members of the plurality of the first and second rigid members, the ratchet mechanism having:

a ratchet at one rigid member of the two adjacent rigid members;

a hinge joint couples the two adjacent rigid members such that the ratchet overlaps another rigid member of the two adjacent rigid members and forms an overlap region; and a pin lock movably engaged with the ratchet along another rigid member at the overlap region.

3. The pliable frame as claimed in claim 2, wherein the one rigid member of the two adjacent rigid members having the ratchet is free to pliably move towards the top side and locked by the pin lock to pliably move towards the bottom side, and the pin lock is required to be pulled to allow pliable movement of the one rigid member of the two adjacent rigid members towards the bottom side.

4. The pliable frame as claimed in claim 1, wherein each of the first and second pliable joints of the first and second arms is a pliable strip or a pliable rod coupled to the two adjacent rigid members of the plurality of the first and second rigid members.

5. The pliable frame as claimed in claim 4, wherein one of the two adjacent rigid members of the plurality of the first and second rigid members is pliably moveable towards the top side or the bottom side by bending the pliable strip.

6. The pliable frame as claimed in claim 4, wherein one of the two adjacent rigid members of the plurality of the first and second rigid members is pliably moveable towards the inner periphery of the pliable frame by bending the pliable rod.

7. The pliable frame as claimed in claim 4, wherein the pliable strip is of a material comprises one of aluminium, copper, bronze, brass, steel, lead, Polyethylene (PE), Polypropylene (PP), Polyvinyl chloride (PVC), Polystyrene (PS), Polyurethane (PU), Acrylonitrile butadiene styrene (ABS), Thermoplastic elastomers (TPE), Polycarbonate (PC), Thermoplastic polyester (PET), Polyvinylidene fluoride (PVDF) or a combination thereof.

8. The pliable frame as claimed in claim 7, wherein each of the first and second pliable joints is a tooth lock mechanism between the two adjacent rigid members of the plurality of the first and second rigid members, the tooth lock mechanism having:

a first engaging member having a plurality of tooths is provided at one rigid member of the two adjacent rigid members; and a second engaging member having a plurality of tooths is provided at other rigid member of the two adjacent rigid members, the second engaging member is configured to couple with the first engaging member on tightening of the tensioning wire.

9. The pliable frame as claimed in claim 8, wherein the first engaging member is of concave shape, and the second engaging member is of convex shape and configured to fit in the first engaging member.

10. The pliable frame as claimed in claim 1 further comprising:

at least one tensioning wire having a first end and a second end, the tensioning wire passes through at least one of the first pliable arm or the second pliable arm and is configured to increase or decrease spacing in each of the first or the second pliable joints, the first end of the tensioning wire is fixed on at least one of the first rigid members or the second rigid members; and at least one tensioning knob provided on at least one of the first rigid members or the second rigid members, the tensioning knob is attached to the second end of the tensioning wire and the tensioning knob is configured to tighten or loosen the tensioning wire.

11. The pliable frame as claimed in claim 1, wherein the tensioning member is one of a spring, or an elastic rubber strip.

12. The pliable frame as claimed in claim 1, wherein the tensioning member is provided on the inner periphery of the pliable frame.

13. The pliable frame as claimed in claim 1, wherein at least one first rigid member of the first pliable arm and at least one second rigid member of the second pliable arm are provided with fins for providing a surface for support.

14. The pliable frame as claimed in claim 1, wherein the first pliable arm and the second pliable arm are covered with a cushioning material.

15. The pliable frame as claimed in claim 1, wherein the pivotal coupling is configured to allow movement of the first pliable arm and the second pliable arm in a horizontal plane.

16. A pliable frame for a pillow and the pliable frame is defined by an inner periphery, an outer periphery, a top side and a bottom side, and the pliable frame comprising:

a first pliable arm having a plurality of first rigid members, and a plurality of first pliable joints coupled to the plurality of first rigid members;

a second pliable arm having a plurality of second rigid members, and a plurality of second pliable joints coupled to the plurality of second rigid members;

a pivotal coupling pivotally couples the first pliable arm and the second pliable arm to provide a pivotal movement of the first and second pliable arms along a pivotal axis; and a tensioning member coupled to the first pliable arm and the second pliable arm proximate to the pivotal coupling to provide tension against the pivotal movement on the first and second pliable arms;

at least one tensioning wire having a first end and a second end, the tensioning wire passes through at least one of the first pliable arm or the second pliable arm and configured to increase or decrease spacing in each of the first or the second pliable joints, the first end of the tensioning wire is fixed on at least one of the first rigid members or the second rigid members;

at least one tensioning knob provided on at least one of the first rigid members or the second rigid members, the tensioning knob is attached to the second end of the tensioning wire and the tensioning knob is configured to tighten or loosen the tensioning wire;

a tooth lock mechanism provided between two adjacent rigid members of the plurality of the first and second rigid members to form each of the first and second pliable joints, the tooth lock mechanism having:

a first engaging member having a plurality of tooths is provided at one rigid member of the two adjacent rigid members; and a second engaging member having a plurality of tooths is provided at other rigid member of the two adjacent rigid members, the second engaging member is configured to couple with the first engaging member on tightening of the tensioning wire.

17. A pillow, comprising:

a pillow body having a medial region and a pair of pliable arms extending from the medial region, a closable opening extends from the medial region to the pair of pliable arms;

a filing material filed in the pillow body; and a pliable frame defined by an inner periphery, an outer periphery, a top side and a bottom side, removably placed inside the pillow body through the closable opening and be covered by the filing material, the pliable frame comprising:

a first pliable arm having a plurality of first rigid members, and a plurality of first pliable joints coupled to the plurality of first rigid members;

a second pliable arm having a plurality of second rigid members, and a plurality of second pliable joints coupled to the second rigid members;

a pivotal coupling pivotally couples the first pliable arm and the second pliable arm to provide a pivotal movement of the first and second pliable arms along a pivotal axis; and a tensioning member coupled to the first pliable arm and the second pliable arm proximate to the pivotal coupling to provide tension against the pivotal movement on the first and second pliable arms.

18. The pillow as claimed in claim 17, wherein each of the first and second pliable joints is a ratchet mechanism between two adjacent rigid members of the plurality of the first and second rigid members, the ratchet mechanism having:

a ratchet at one rigid member of the two adjacent rigid members;

a hinge joint couples the two adjacent rigid members such that the ratchet overlaps another rigid member of the two adjacent rigid members and forms an overlap region; and a pin lock movably engaged with the ratchet along another rigid member at the overlap region.

19. The pillow as claimed in claim 18, wherein the one rigid member of the two adjacent rigid members having the ratchet is free to pliably move towards the top side and locked by the pin lock to pliably move towards the bottom side, and the pin lock is required to be pulled to allow pliable movement of the one rigid member of the two adjacent rigid members towards the bottom side.

20. The pillow as claimed in claim 17, wherein each of the first and second pliable joints is a pliable strip or a pliable rod coupled to the two adjacent rigid members of the plurality of the first and second rigid members.

21. The pillow as claimed in claim 20, wherein one of the two adjacent rigid members of the plurality of the first and second rigid members is pliably moveable towards the top side or the bottom side by bending the pliable strip.

22. The pillow as claimed in claim 20, wherein one of the two adjacent rigid members of the plurality of the first and second rigid members is pliably moveable towards the inner periphery by bending the pliable strip.

23. The pillow as claimed in claim 17, wherein the pliable frame further comprises:

at least one tensioning wire having a first end and a second end, the tensioning wire passes through at least one of the first pliable arm or the second pliable arm and configured to increase or decrease spacing in each of the first or the second pliable joints, the first end of the tensioning wire is fixed on at least one of the first rigid members or the second rigid members; and at least one tensioning knob provided on at least one of the first rigid members or the second rigid members, the tensioning knob is attached to the second end of the tensioning wire and the tensioning knob is configured to tighten or loosen the tensioning wire.

24. The pillow as claimed in claim 23, wherein each of the first and second pliable joints is a tooth lock mechanism between the two adjacent rigid members of the plurality of the first and second rigid members, the tooth lock mechanism having:

a first engaging member having a plurality of tooths is provided at one rigid member of the two adjacent rigid members; and a second engaging member having a plurality of tooths is provided at other rigid member of the two adjacent rigid members, the second engaging member is configured to couple with the first engaging member on tightening of the tensioning wire.

25. The pillow as claimed in claim 17 is a nursing pillow and the pliable arms of the pillow are bendable to accommodate a baby placed on the top side of the pillow.

* * * * *